US008265307B2

(12) United States Patent
Hama

(10) Patent No.: US 8,265,307 B2
(45) Date of Patent: Sep. 11, 2012

(54) ACOUSTIC TRANSDUCER

(75) Inventor: Yoshinori Hama, Tokyo (JP)

(73) Assignee: NEC Corporation, Tokyo (JP)

( * ) Notice: Subject to any disclaimer, the term of this patent is extended or adjusted under 35 U.S.C. 154(b) by 258 days.

(21) Appl. No.: 12/829,142

(22) Filed: Jul. 1, 2010

(65) Prior Publication Data

US 2011/0002484 A1 Jan. 6, 2011

(30) Foreign Application Priority Data

Jul. 3, 2009 (JP) ..... P2009-158773

(51) Int. Cl.
*H04R 25/00* (2006.01)

(52) U.S. Cl. ..... 381/150; 381/338; 381/345; 381/351; 381/423; 381/425

(58) Field of Classification Search ..... None
See application file for complete search history.

(56) References Cited

U.S. PATENT DOCUMENTS

| | | | | |
|---|---|---|---|---|
| 4,922,470 | A | 5/1990 | McMahon et al. | |
| 6,851,512 | B2 * | 2/2005 | Fox et al. | 181/158 |
| 7,181,038 | B2 * | 2/2007 | Rivera et al. | 381/396 |
| 7,466,066 | B2 * | 12/2008 | Porzio et al. | 310/334 |
| 7,677,673 | B2 * | 3/2010 | Tranquilla et al. | 299/2 |
| 7,772,746 | B2 * | 8/2010 | Keolian et al. | 310/339 |
| 2006/0113872 | A1 * | 6/2006 | Porzio et al. | 310/328 |
| 2007/0083149 | A1 * | 4/2007 | Steward et al. | 604/22 |
| 2007/0088246 | A1 * | 4/2007 | Steward et al. | 604/22 |
| 2011/0002484 | A1 * | 1/2011 | Hama | 381/152 |
| 2011/0075521 | A1 * | 3/2011 | Hama | 367/160 |
| 2011/0280420 | A1 * | 11/2011 | Hama | 381/186 |

FOREIGN PATENT DOCUMENTS

| | | | |
|---|---|---|---|
| JP | 5-344582 | A | 12/1993 |
| JP | 2011015271 | A * | 1/2011 |

OTHER PUBLICATIONS

"Fundamentals and Applications of Marine Acoustics", Marine Acoustics Society of Japan, Seizando, Apr. 2004, pp. 58-60.

* cited by examiner

*Primary Examiner* — Marlo Fletcher

(57) ABSTRACT

An acoustic transducer radiates a sound wave into a medium, and includes: a shaft member which extends at a center portion of the acoustic transducer; first and second cylindrical acoustic radiation plates which have a cylindrical shape, a central axis of the first and second cylindrical acoustic radiation plates agreeing with the longitudinal axis of the shaft member, the first and second cylindrical acoustic radiation plates alternately arranged in a direction of the central axis; a plurality of connection members which have a ring shape, and connect adjacent first and second acoustic radiation plates to each other; a plurality of bending vibration plates each of which connects the shaft member and one of the connection members to each other; and a plurality of vibrators which are provided on the bending plates. The first acoustic radiation plate has a sectional shape which is curved outwardly in a radial direction thereof, and the sectional shape of the first acoustic radiation plate is along a plane including the central axis. The second acoustic radiation plate has a sectional shape which is curved inwardly in a radial direction thereof, and the sectional shape of the second acoustic radiation plate is along a plane including the central axis.

17 Claims, 14 Drawing Sheets

ACOUSTIC TRANSDUCER

This application is based upon and claims the benefit of priority from Japanese patent application No. 2009-158773, filed on Jul. 3, 2009, the disclosure of which is incorporated herein in its entirety by reference.

BACKGROUND OF THE INVENTION

1. Field of the Invention

The present invention relates to an acoustic transducer (i.e., electroacoustic converter) which radiates a sound wave into air or water, and in particular to an acoustic transducer capable of efficiently radiating a sound wave at a low frequency.

2. Description of Related Art

An acoustic transducer which radiates a sound wave into a medium, such as water, is used in the field of oceanographic observation or the like. As the frequency of a sound wave to be used is low, attenuation is small and a propagation characteristic is excellent, such that acoustic radiation can be carried out over a long distance. For this reason, in recent years, an acoustic transducer which radiates a sound wave having a low frequency by excluding many mediums, such as water, in the vicinity of the acoustic radiation surface, has come into practical use.

As the acoustic transducer of the related art which is used in water, various types including a bolted Langevin type transducer, a cylindrical transducer, a flextensional transducer, a bending disc-type transducer, a barrel stave-type transducer, and the like are currently used.

According to "Fundamentals and Applications of Marine Acoustics (edited by Marine Acoustics Society of Japan)", Seizando, Apr. 28, 2004, p. 58-60 (hereinafter, referred to as Non-Patent Document 1), a bolted Langevin transducer (also referred to as a tonpilz transducer due to its shape) 101 shown in FIGS. 14A and 14B is configured such that an acoustic radiation plate 104 is provided on one end surface of a vibrator module 103 having a plurality of annular piezoelectric vibrators 102. The vibrator module 103 causes acoustic radiation from the acoustic radiation plate 104 using a vibration mode where the vibrator module 103 longitudinally vibrates in half wavelength.

A cylindrical transducer 111 shown in FIGS. 15A and 15B is configured such that an acoustic radiation plate 114 is provided on the outer circumferential surface of a cylindrical vibrator 112. The cylindrical transducer 111 causes acoustic radiation from the acoustic radiation plate 114 using a breathing vibration mode in a radial direction of the cylindrical vibrator 112, that is, using a mode where longitudinal vibration with one wavelength is formed on the circumferential length of the cylinder.

A flextensional transducer 121 shown in FIGS. 16A and 16B is configured so as to expand the amplitude by converting vibration of a vibrator 122 into bending vibration of a bending acoustic radiation plate 124 using an elliptical shell having an elliptical sectional shape and to cause acoustic radiation of the displacement of the vibrator 122 by using flexural vibration of the bending acoustic radiation plate 124, instead of directly radiating a sound wave into water by using resonance of the vibrator.

According to Japanese Unexamined Patent Application, First Publication No. H5-344582 (hereinafter, referred to as Patent Document 1), a bending disc-type transducer 131 shown in FIGS. 17A and 17B is configured such that a disc-type vibrator 132 is bonded to a bending acoustic radiation plate 134, and flexural resonance of the bending acoustic radiation plate 134 is used, thereby causing acoustic radiation of the displacement of the vibrator 132.

The acoustic transducers 121 and 131 respectively employ the bending acoustic radiation plates 124 and 134 which use bending vibration whose resonance frequency is easily obtained with a low frequency compared to longitudinal vibration, such that many mediums can be excluded.

According to U.S. Pat. No. 4,922,470 (hereinafter, referred to as Patent Document 2), a barrel stave-type transducer 141 shown in FIGS. 18A and 18B is configured such that a plurality of bent acoustic radiation plates 144 are provided at the outer circumferential portion, and a gap d1 is provided between adjacent acoustic radiation plates 144.

Meanwhile, an electrodynamic loudspeaker (i.e., acoustic transducer) which is generally used in air transfers vibration of a coil by an electromagnetic force to a cone paper, thereby causing acoustic radiation from the cone paper.

With regard to acoustic radiation into air, acoustic radiation impedance is small, thus it is possible to secure a large excluded medium volume with a lightweight material, such as paper.

However, the acoustic transducers of the related art have the following problems.

In the bolted Langevin transducer 101 shown in FIGS. 14A and 14B and the cylindrical transducer 111 shown in FIGS. 15A and 15B, in order to increase the excluded medium volume, it is necessary to increase the displacement of the acoustic radiation plate by increasing the length or diameter of the vibrator, which causes an increase in the size and weight of the acoustic transducer Thus, at present, these acoustic transducers are used with a frequency greater than or equal to 1 kHz due to the limitations on size and the like.

In the flextensional transducer 121 shown in FIGS. 16A and 16B and the bending disc-type transducer 131 of Patent Document 1 shown in FIGS. 17A and 17B, in order to increase the excluded medium volume, it is necessary to increase the area of the acoustic radiation plate. In this case, the acoustic transducer increases in size and weight.

In particular, when piezoelectric ceramic having a large mass is used for the bending vibration plate, a structure is made such that a large amplitude location has a large mass, and a low resonance frequency is obtained. However, the weight may increase and the degree of sharpness of the resonance frequency may be high, such that this type of transducer is not suitable for acoustic radiation over a wide band.

In the barrel stave-type transducer 141 shown in FIGS. 18A and 18B, a gap is required between adjacent acoustic radiation plates. For this reason, if the entire transducer is molded for watertightness, the vibration of the gap d1 may be disturbed due to water pressure and the efficiency of acoustic radiation may be deteriorated.

With regard to the electrodynamic loudspeaker which is used in air, in order to increase the excluded medium volume, a larger cone paper is used, and as a result, the loudspeaker increases in size. Further, like the piezoelectric loudspeaker, when the piezoelectric vibrator is bonded to the vibration plate to form acoustic radiation, in order to increase the excluded medium volume, it is necessary to increase the diameter of the vibration plate.

When an acoustic transducer is provided in an underwater sailing body or a towing body, it is desirable that the specific gravity of the acoustic transducer is close to or smaller than the specific gravity of the medium (such as water). If the specific gravity of the acoustic transducer is greater than that of the medium, a floating buoyant material for floating the acoustic transducer is required, in the case of the underwater sailing body, and the acoustic transducer drops in the case of the towing body where there is no space for providing a floating buoyant material. In the acoustic transducer of the related art where acoustic radiation with a low frequency is possible, there are many cases where piezoelectric ceramic is used for the vibrator, and the specific gravity of the acoustic transducer is usually greater than or equal to one.

Further, an acoustic transducer which is used in a towing body is accommodated to be cylindrically wound at the time of being accommodated and is substantially used in a linear shape at the time of operation. For this reason, at the time of being accommodated, large bending stress is applied to the acoustic transducer, such that the acoustic transducer is damaged.

SUMMARY OF THE INVENTION

The invention has been finalized in consideration of the above-described problems. An exemplary object of the invention is to provide an acoustic transducer which can efficiently exclude a medium in the vicinity of an acoustic radiation plate without increasing the shape of a vibrator or acoustic radiation plate.

In order to achieve the above-described object, an exemplary aspect of the invention provides an acoustic transducer radiates a sound wave into a medium, and includes: a shaft member which extends at a center portion of the acoustic transducer; first and second cylindrical acoustic radiation plates which have a cylindrical shape, a central axis of the first and second cylindrical acoustic radiation plates agreeing with a longitudinal axis of the shaft member, the first and second cylindrical acoustic radiation plates alternately arranged in a direction of the central axis; a plurality of connection members which have a ring shape, and connect adjacent first and second acoustic radiation plates to each other; a plurality of bending vibration plates each of which connects the shaft member and one of the connection members to each other; and a plurality of vibrators which are provided on the bending plates. The first acoustic radiation plate has a sectional shape which is curved outwardly in a radial direction thereof, and the sectional shape of the first acoustic radiation plate is along a plane including the central axis. The second acoustic radiation plate has a sectional shape which is curved inwardly in a radial direction thereof, and the sectional shape of the second acoustic radiation plate is along a plane including the central axis.

An exemplary advantage according to the aspect of the invention is that mediums in the vicinity of the first and second acoustic radiation plates can be efficiently excluded without increasing the size of the acoustic radiation plate or the vibrator. Therefore, acoustic radiation with a low frequency can be performed, and a reduction in size and weight of the acoustic transducer can be achieved.

DETAILED DESCRIPTION OF THE INVENTION

Hereinafter, an acoustic transducer according to a first exemplary embodiment of the invention will be described with reference to FIGS. 1A to 5.

Figure 1A:
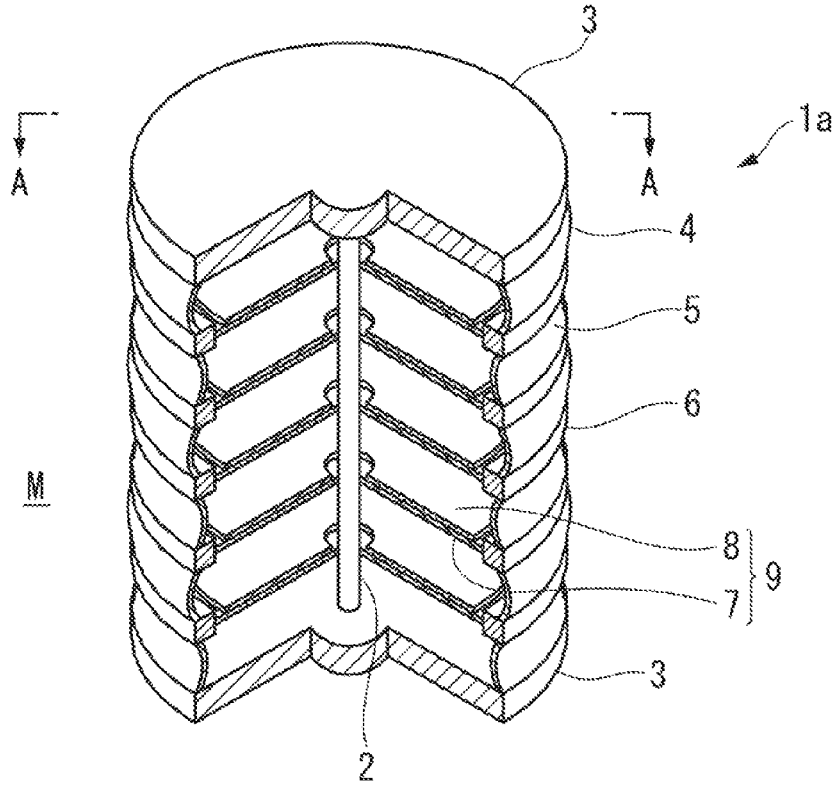
FIG. 1A is a partial sectional perspective view showing an example of an acoustic transducer according to a first exemplary embodiment of the invention.
Figure 1B:
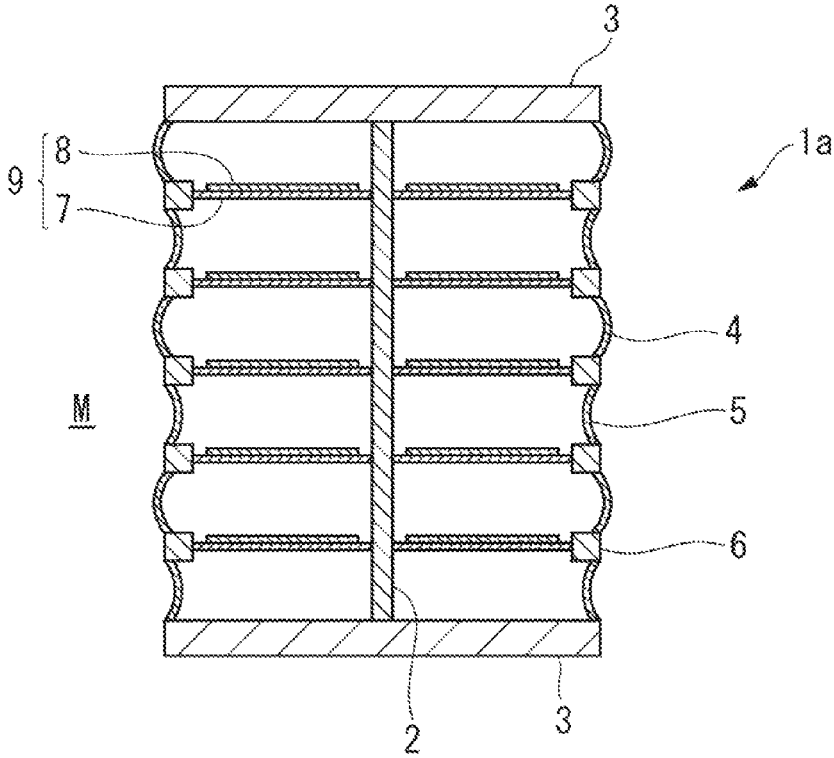
FIG. 1B is a sectional view taken along line A-A of FIG. 1A.

As shown in FIGS. 1A and 1B, an acoustic transducer 1*a* of the first exemplary embodiment has a shaft (shaft member) 2, end plates 3, first acoustic radiation plates 4, and second acoustic radiation plates 5. The shaft 2 extends at the center portion of the acoustic transducer 1*a*. The end plates 3 are provided at both ends of the shaft 2 so that their normal direction agrees with the axial direction of the shaft 2. The first acoustic radiation plates 4 have a cylindrical shape such that the sectional shape is curved outwardly at a plane including the axis thereof. The second acoustic radiation plates 5 have a cylindrical shape such that the sectional shape is curved inwardly at a plane including the axis thereof. The first acoustic radiation plates 4 and the second acoustic radiation plates 5 are alternately arranged between the end plates 3 with their axial directions agreeing with each other. A central axis of the first and second acoustic radiation plates 4 and 5 agrees with a longitudinal axis of the shaft 2.

An acoustic transducer 1*a* also includes connection members 6 having a ring shape, flexible bending vibration plates 7 having a disc shape and having flexible characteristics, and a piezoelectric vibrator (i.e., vibrator) 8 having a ring shape and having a thin plate shape.

The ring-shaped connection members 6 are respectively provided between the first acoustic radiation plates 4 and the second acoustic radiation plates 5 to connect the ends of the first acoustic radiation plates 4 and the ends of the second acoustic radiation plates 5.

The disc-shaped flexible bending vibration plates 7 are respectively fixed inside the connection members 6 so as to be inscribed in the connection members 6. The bending vibration plates 7 are fixed to the shaft 2 which passes through the center portions thereof. The ring-shaped piezoelectric vibrator 8 is bonded to one surface of each of the bending vibration plates 7. The bending vibration plate 7 and the piezoelectric vibrator 8 bonded to one surface of the bending vibration plate 7 constitute a bending vibration module 9 having a unimorph structure. The acoustic transducer 1*a* configured as above is entirely molded with synthetic resin (not shown) or the like and is electrically insulated from an ambient medium M, such as water.

The first and second acoustic radiation plates 4 and 5 radiate sound waves into a medium such as water, and are formed of a flexible material. The first and second acoustic radiation plates 4 and 5 are connected to the bending vibration plates 7 through the connection members 6. Since the bending vibration plates 7 are disc-shaped members which are inscribed in the connection members 6, bending vibration of the bending vibration plates 7 can be transferred to the first and second acoustic radiation plates 4 and 5.

It is preferable that the first and second acoustic radiation plates 4 and 5 are formed of a synthetic resin or a material containing a synthetic resin, and this material has a honeycomb structure.

It is preferable that the bending vibration plates 7 are formed of a synthetic resin or a material containing a synthetic resin, and this material has a honeycomb structure or a laminated structure.

Next, an operation of the acoustic transducer 1*a* of the first exemplary embodiment will be described.

Figure 2A:
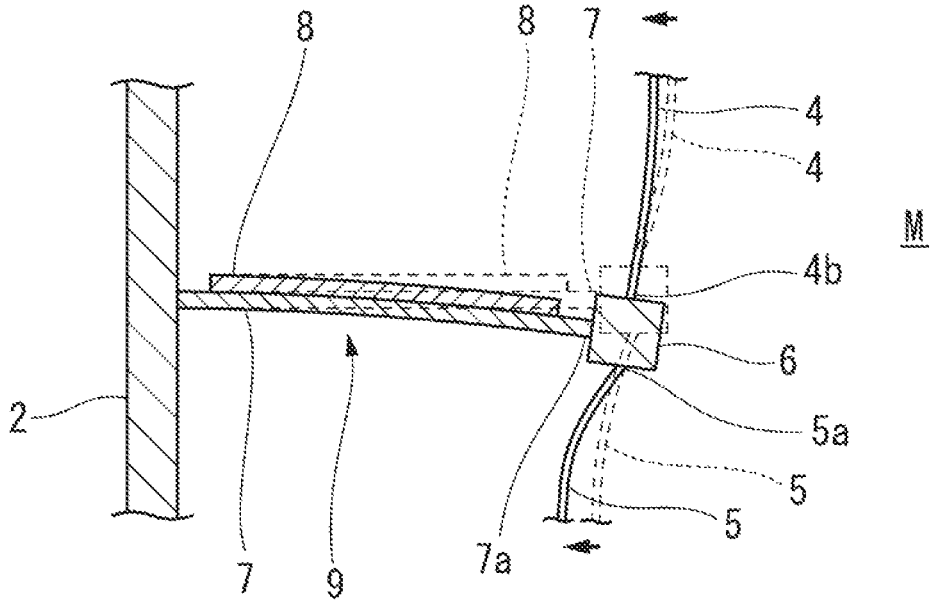
FIG. 2A is a diagram illustrating an operation of the acoustic transducer shown in FIG. 1A.
Figure 2B:
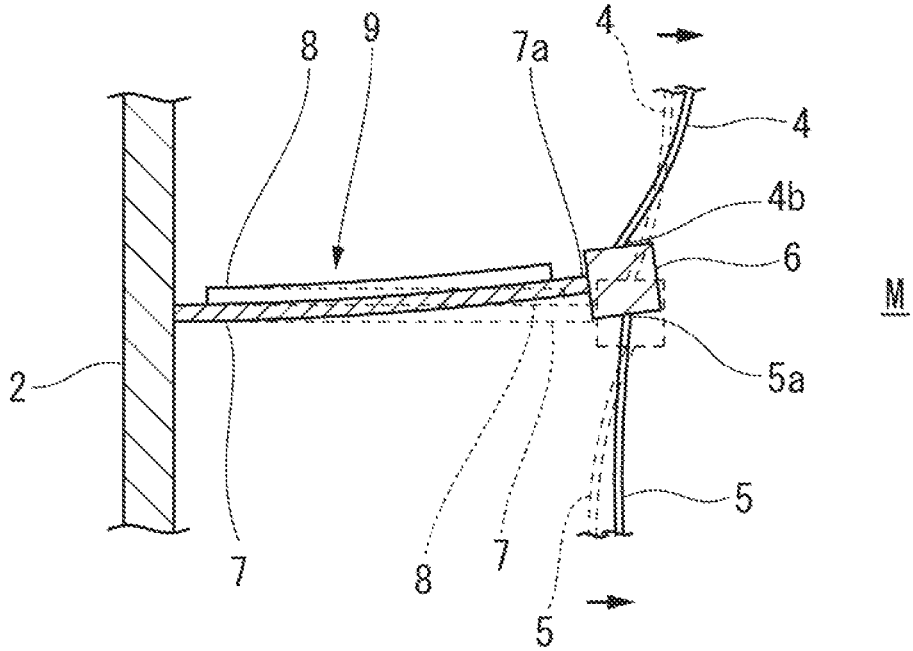
FIG. 2B is a diagram illustrating an operation of the acoustic transducer shown in FIG. 1A.

As shown in FIGS. 2A and 2B, if a predetermined application voltage is input, the piezoelectric vibrators 8 are displaced in the up-down direction in accordance with the direction of the application voltage. This displacement causes the bending vibration plates 7, to which the piezoelectric vibrators 8 are bonded, to be bent, and the bending vibration plates 7 bending-vibrate in the up-down direction. The bending vibration of the bending vibration plates 7 causes the first and second acoustic radiation plates 4 and 5 connected thereto by the connection members 6 to be displaced, such that the ambient medium M is excluded.

Description will be provided for a case where, as shown in FIG. 2A, in a portion where the first acoustic radiation plate 4 is arranged above the connection member 6 and the second acoustic radiation plate 5 is arranged below the connection member 6, an outer edge 7*a* of the bending vibration plate 7 fixed to the connection member 6 is displaced downward. In this exemplary embodiment, description will be provided assuming that the axial direction of the shaft 2 is the up-down (i.e., vertical) direction.

If the outer edge 7*a* of the bending vibration plate 7 is displaced downward, the connection member 6 is also displaced downward, and a lower end 4*b* of the first acoustic radiation plate 4 is pulled down. When this happens, the curvature of the sectional shape in the axial direction (hereinafter, referred to as curvature) is reduced, and the outer circumferential surface thereof is displaced inwardly. Meanwhile, an upper end 5*a* of the second acoustic radiation plate 5 is compressed from above, thus the curvature increases and the outer circumferential surface thereof is displaced inwardly. In the figures, the respective members before being displaced are represented by dotted lines.

Since the outer circumferential surfaces of the first and second acoustic radiation plates 4 and 5 are displaced inwardly as discussed above, the ambient medium M can be excluded. At this time, the first and second acoustic radiation plates 4 and 5 perform inward medium exclusion.

Next, description will be provided for a case where, as shown in FIG. 2B, in a portion where the first acoustic radiation plate 4 is arranged above the connection member 6, and the second acoustic radiation plate 5 is arranged below the connection member 6, the outer edge 7*a* of the bending vibration plate 7 fixed to the connection member 6 is displaced upward.

If the outer edge 7*a* of the bending vibration plate 7 is displaced upward, the connection member 6 is also displaced upward, and the lower end 4*b* of the first acoustic radiation plate 4 is compressed upward, such that the curvature increases and the outer circumferential surface thereof is displaced outwardly. Meanwhile, the upper end 5*a* of the second acoustic radiation plate 5 is pulled up, thus the curvature is reduced and the outer circumferential surface thereof is displaced outwardly.

Since the outer circumferential surfaces of the first and second acoustic radiation plates 4 and 5 are displaced outwardly as discussed above, outward medium exclusion is performed.

The bending vibration plate 7 is alternately displaced in the up-down direction by the vibration of the piezoelectric vibrator 8, such that the first and second acoustic radiation plates 4 and 5 are alternately displaced inwardly and outwardly to perform medium exclusion.

At this time, the resonance frequency of each of the first and second acoustic radiation plates 4 and 5 is set to be identical to the resonance frequency of each of the bending vibration plates 7. Such setting enables superimposition of the displacement of each of the first and second acoustic radiation plates 4 and 5 and the displacement of each of the bending vibration plates 7, thus larger medium exclusion can be performed.

Suppose that the displacement directions of adjacent bending vibration plates 7 are identical. In this case, when the upper ends of the first and second acoustic radiation plates 4 and 5 are compressed downward, the lower ends thereof are pulled down. Meanwhile, when the upper ends of the first and second acoustic radiation plates 4 and 5 are compressed downward, the lower ends thereof are pulled down. Therefore, the first and second acoustic radiation plates 4 and 5 are only displaced in the up-down direction, and the curvature of the outer circumferential surface is not changed, and thus, medium exclusion almost never occurs.

In view of the above, the piezoelectric vibrators 8 are arranged such that the displacement direction of the bending vibration plate 7 is opposite to the displacement direction of the bending vibration plates 7 arranged above and below it. With this structure, the curvature of the outer circumferential surfaces of the first and second acoustic radiation plates 4 and 5 is changed, such that medium exclusion can be efficiently performed.

Next, description will be provided for an arrangement method of the bending vibration plates 7 and the piezoelectric vibrators 8 such that the displacement direction of the bending vibration plate 7 is opposite to the displacement direction of the bending vibration plates 7 arranged above and below it.

Figure 3:
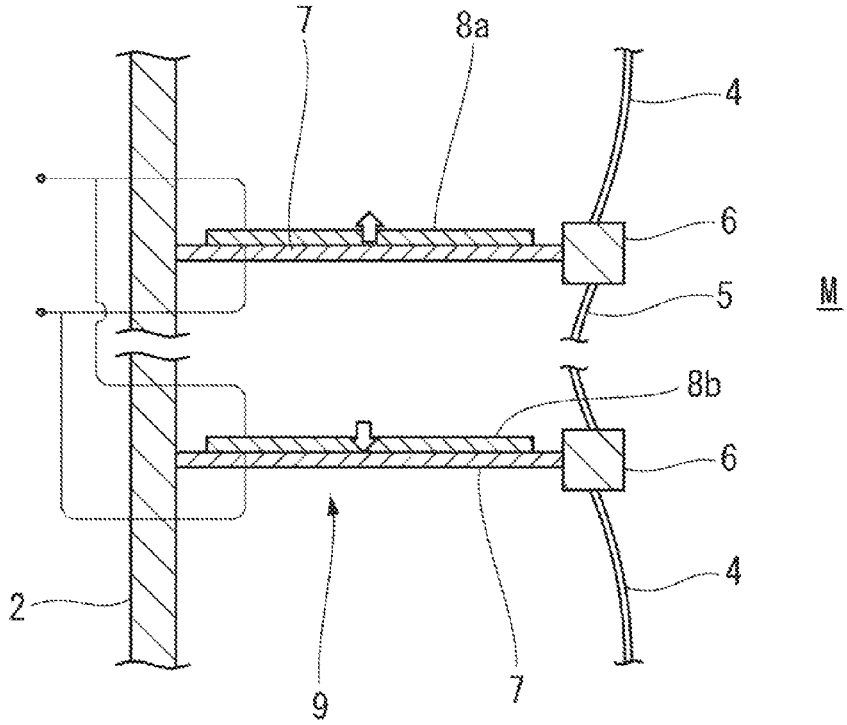
FIG. 3 is a diagram showing an arrangement method of piezoelectric vibrators according to the first exemplary embodiment.

As shown in FIG. 3, a bending vibration plate 7 to which a piezoelectric vibrator 8*a* having an upward polarization direction is bonded on the upper surface and a bending vibration plate 7 to which a piezoelectric vibrator 8*b* having a downward polarization direction is bonded on the upper surface are alternately arranged.

If the bending vibration plates 7 and the piezoelectric vibrators 8*a* and 8*b* are arranged as described above, the displacement directions of piezoelectric vibrators 8 adjacent to each other in the up-down direction can be opposite to each other. The piezoelectric vibrators 8*a* and 8*b* may be respectively arranged on the lower surfaces of the bending vibration plates 7.

Figure 4:
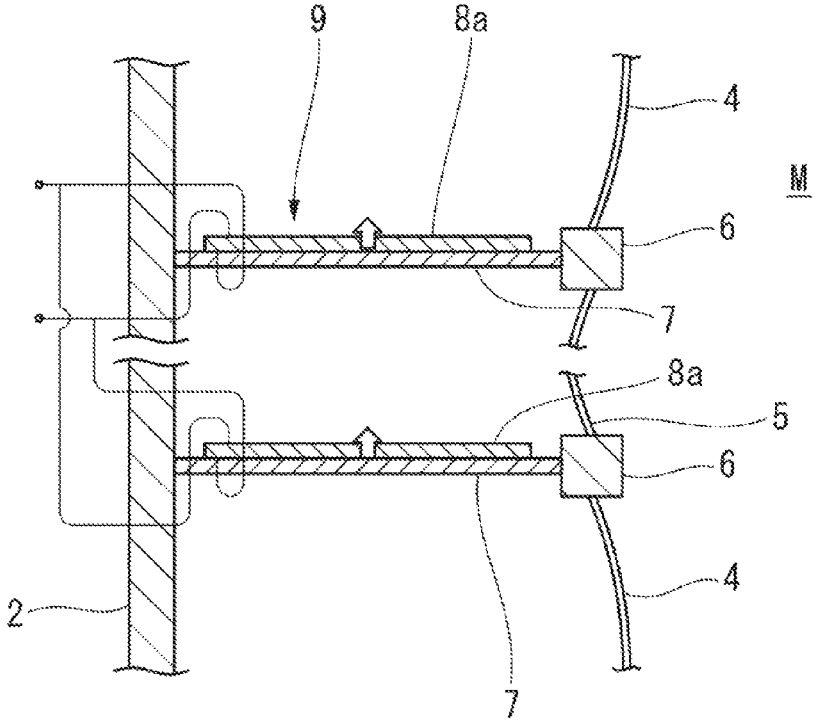
FIG. 4 is a diagram showing another arrangement method of piezoelectric vibrators according to the first exemplary embodiment.

Alternatively, as shown in FIG. 4, bending vibration plates 7 to which piezoelectric vibrators 8*a* having an upward polarization direction are bonded on the upper surface are arranged, and the wiring connection to the piezoelectric vibrator 8*a* arranged on the upper surface of the bending vibration plate and the wiring connection to the piezoelectric vibrator 8*a* arranged on the lower surface of the bending vibration plate are inverted to each other in the up-down direction. If the bending vibration plates 7 and the piezoelectric vibrators 8*a* are arranged as described above, the displacement directions of adjacent piezoelectric vibrators 8 in the up-down direction can be opposite to each other. A piezoelectric vibrator 8*b* having a downward polarization direction may be bonded to the upper surface of each of the bending vibration plates 7, or a piezoelectric vibrator 8*b* having a unified upward or downward polarization direction may be bonded to the lower surface of each of the bending vibration plates 7.

Figure 5:
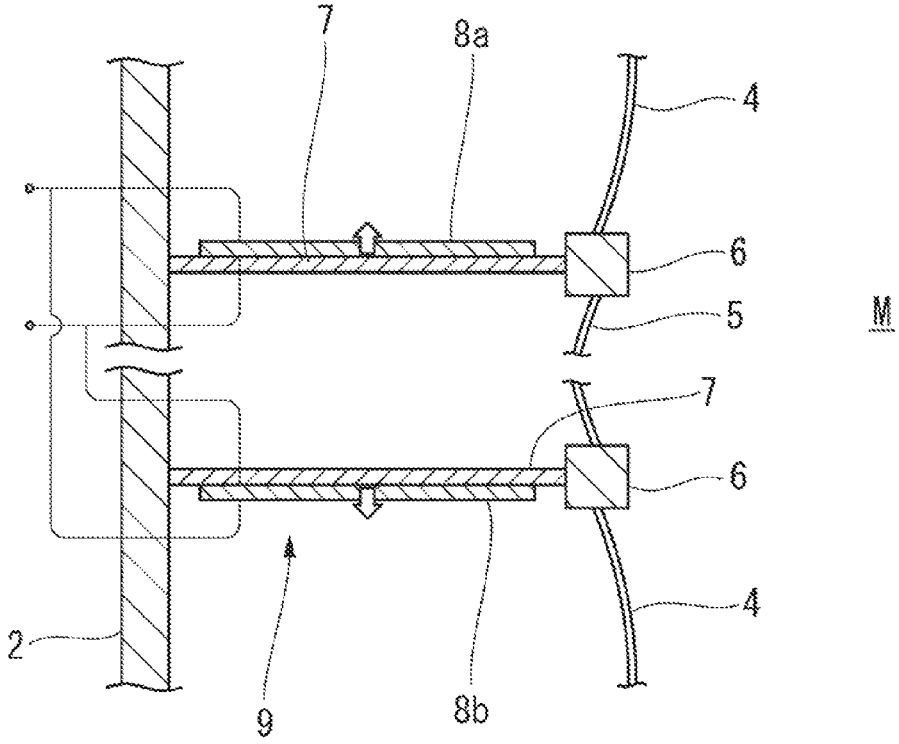
FIG. 5 is a diagram showing yet another arrangement method of piezoelectric, vibrators according to the first exemplary embodiment.

Instead of the above-described structure, as shown in FIG. 5, a bending vibration plate 7 to which a piezoelectric vibrator 8*a* having an upward polarization direction is bonded on the upper surface and a bending vibration plate 7 to which a piezoelectric vibrator 8*b* having a downward polarization direction is bonded on the lower surface may be alternately arranged.

The present embodiment is not limited to the above-described arrangement methods of the bending vibration plates 7 and the piezoelectric vibrators 8. The displacement directions of adjacent bending vibration plates 7 may be set to opposite to each other by adjusting at least one of the followings: the positions of the piezoelectric vibrators 8 with respect to the bending vibration plates 7, the polarization directions of the piezoelectric vibrators 8, or the wiring connections to the piezoelectric vibrators 8.

Next, operation and effects of the acoustic transducer 1*a* of the first exemplary embodiment will be described with reference to the drawings.

The acoustic transducer 1*a* of the first exemplary embodiment is configured such that the cylindrical first acoustic radiation plates 4 having a sectional shape curved outwardly at the plane including the axis in the cylindrical shape and the second acoustic radiation plates 5 having a sectional shape curved inwardly at the plane including the axis in the cylindrical shape are alternately arranged. Further, the first and second acoustic radiation plates 4 and 5 are displaced with the displacement of the bending vibration plates 7, and the curvature of the first and second acoustic radiation plates 4 and 5 is changed. For this reason, according to the acoustic transducer 1*a* of the first exemplary embodiment, the excluded volume of the medium M can be increased, and acoustic radiation with a low frequency can be realized, as compared to an acoustic transducer of the related art which includes a cylindrical acoustic radiation plate whose sectional shape on the plane or in the axial direction is not curved radially.

Since the piezoelectric vibrators 8 are arranged such that the displacement directions of adjacent bending vibration plates 7 are opposite to each other, file curvature of the first and second acoustic radiation plates 4 and 5 is changed, resulting in increase in the excluded volume of the medium M.

The piezoelectric vibrators 8 are bonded to the bending vibration plates 7, such that the bending vibration plates 7 bending-vibrate. Therefore, the resonance frequency can be reduced compared to the longitudinal vibration, and the output frequency can be lowered.

The sectional shapes along with the axial direction of the first and second acoustic radiation plates 4 and 5 are curved radially, and the curvature of the first and second acoustic radiation plates 4 and 5 is changed with the displacement of the piezoelectric vibrators 8 to perform medium exclusion. Therefore, there is no need to increase the shape of the first and second acoustic radiation plates 4 and 5 or the piezoelectric vibrators 8, and thus reduction in size and weight of the acoustic transducer 1*a* can be achieved.

The first and second acoustic radiation plates 4 and 5 are formed of a synthetic resin or a material containing a synthetic resin, and the material has a honeycomb structure. Therefore, the first and second acoustic radiation plates 4 and 5 can be lightweight and have sufficient strength, such that the reduction in weight of the acoustic transducer 1*a* can be achieved.

The bending vibration plates 7 are formed of a synthetic resin or a material containing a synthetic resin, and the material has a honeycomb structure or a laminated structure. Therefore, the bending vibration plate 7 can be lightweight and have sufficient strength, such that the reduction in weight of the acoustic transducer 1*a* can be achieved.

The end plates 3 are provided at both ends of the shaft 2, such that a medium, such as water, can be prevented from flowing into the first and second acoustic radiation plates 4 and 5.

Next, other exemplary embodiments will be described with reference to the accompanying drawings. The members or portions the same as or equivalent to those in the first exemplary embodiment are represented by the same reference numerals, and description thereof will be described. Differences from the first exemplary embodiment will be described.

Figure 6:
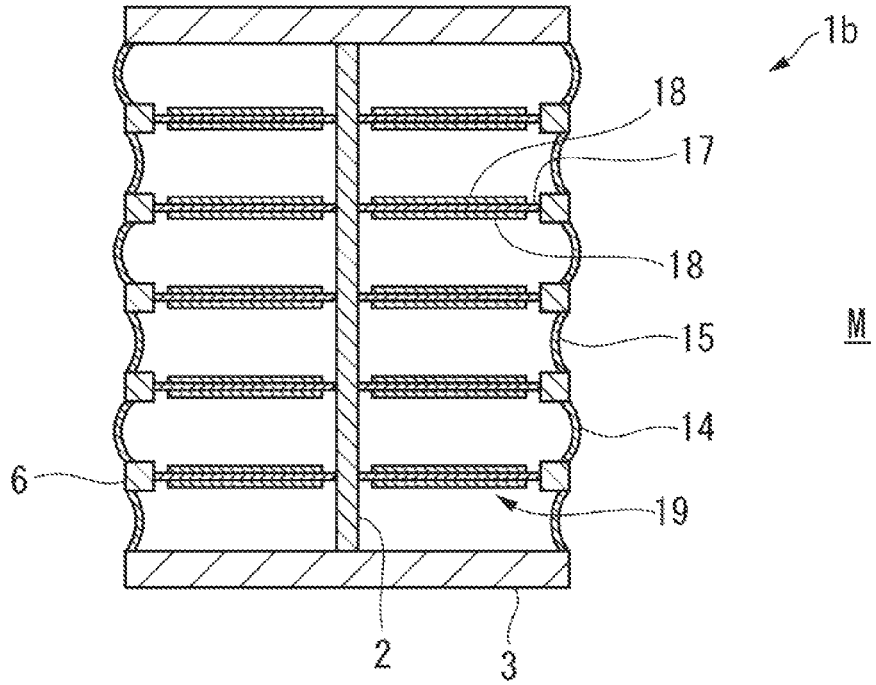
FIG. 6 is a diagram showing an example of an acoustic transducer according to a second exemplary embodiment of the invention.

An acoustic transducer of a second exemplary embodiment will be described below. As shown in FIG. 6, an acoustic transducer 1*b* of the second exemplary embodiment is configured such that piezoelectric vibrators 18 are bonded to the upper and lower surfaces of each of the bending vibration plates 17. The bending vibration plate 17 and the piezoelectric vibrators 18 bonded to both surfaces of the bending vibration plate 17 constitute a bending vibration module 19 having a bimorph structure.

At this time, similarly to the first exemplary embodiment, the piezoelectric vibrators 18 are arranged such that the displacement direction of each of the bending vibration plates 17 is opposite to the displacement directions of the bending vibration plates 7 arranged above and below the relevant bending vibration plate 7.

Figure 7:
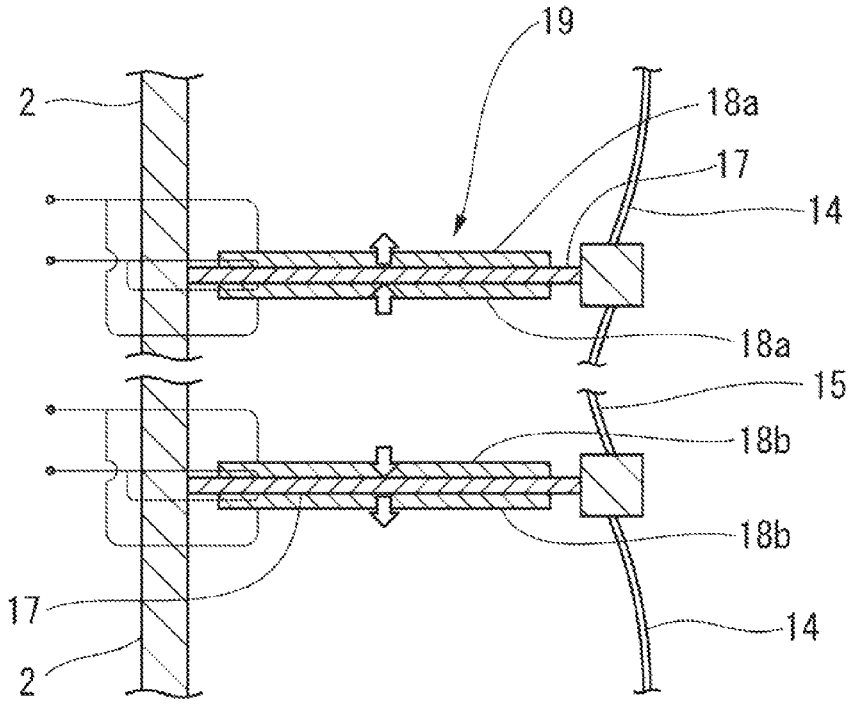
FIG. 7 is a diagram showing an arrangement method of piezoelectric vibrators according to the second exemplary embodiment.

For example, as shown in FIG. 7, a bending vibration plate 17 to which piezoelectric vibrators 18*a* having an upward polarization direction are bonded on the upper and lower surface and a bending vibration plate 17 to which piezoelectric vibrators 18*b* having a downward polarization direction are bonded on the upper and lower surfaces are alternately arranged.

Figure 8:
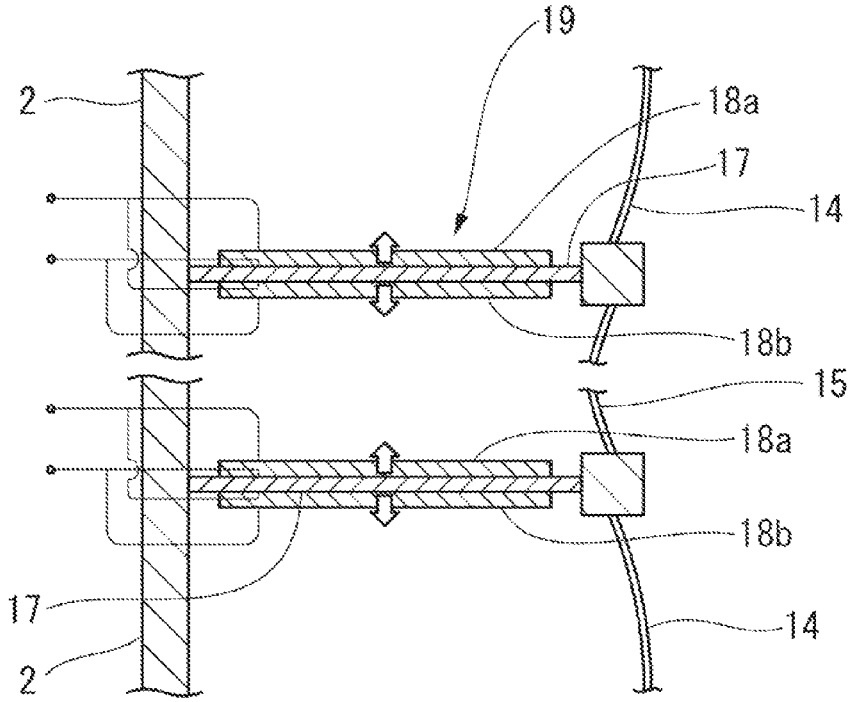
FIG. 8 is a diagram showing another arrangement method of piezoelectric vibrators according to the second exemplary embodiment.

Alternatively, as shown in FIG. 8, piezoelectric vibrators 18*a* and 18*b* having different polarization directions are arranged on the upper and lower surfaces of the bending vibration plate 17, and the wiring connection to the piezoelectric vibrator 18*a* and the wiring connection to the piezoelectric vibrator 18*b* are opposite to each other, such that the displacement directions of adjacent bending vibration plates 17 are opposite to each other.

The present embodiment is not limited to the above-described arrangement method of the piezoelectric vibrators 18. The displacement directions of adjacent bending vibration plates 71 may be set to opposite to each other by adjusting at least one of the followings: the polarization directions of the piezoelectric vibrators 18, or the wiring connections to the piezoelectric vibrators 18 and 19.

According to the acoustic transducer 1*b* of the second exemplary embodiment, the piezoelectric vibrators 18 are bonded to both surfaces of each of the bending vibration plates 17. Therefore, the bending vibration plates 17 can reliably bending-vibrate compared to the first exemplary embodiment. As a result, medium exclusion by the first and second acoustic radiation plates 14 and 15 can be efficiently performed.

Figure 9A:
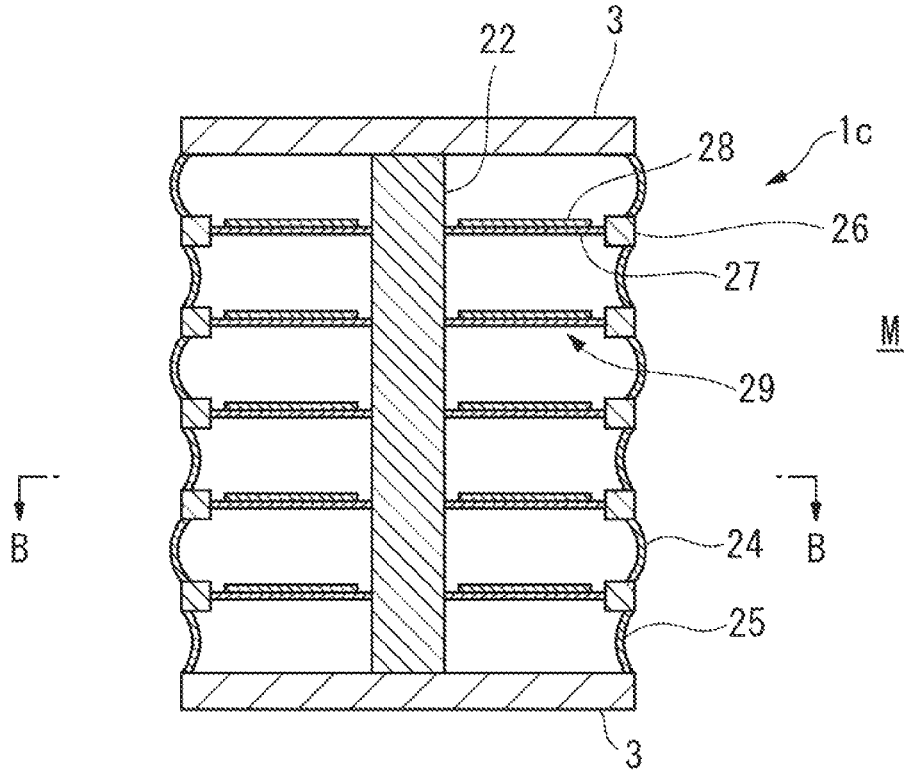
FIG. 9A is a diagram showing an example of an acoustic transducer according to a third exemplary embodiment of the invention.
Figure 9B:
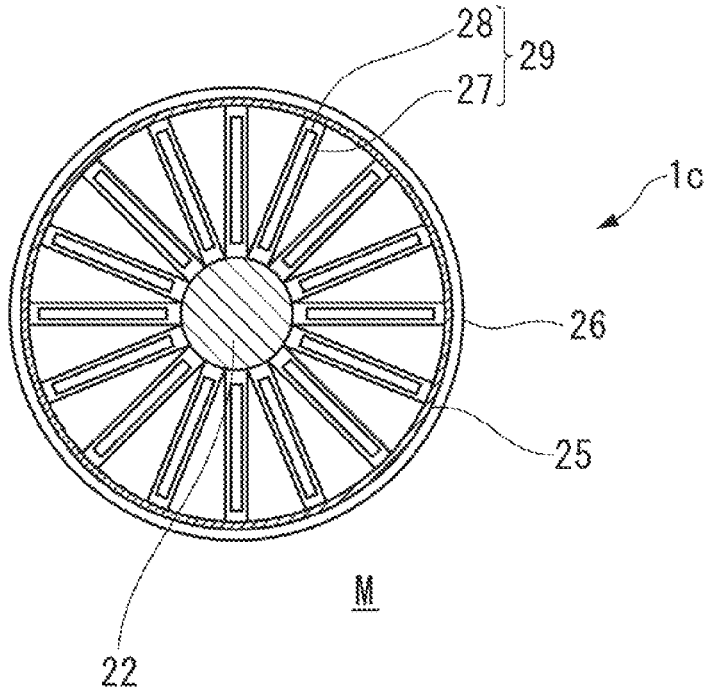
FIG. 9B is a sectional view taken along line B-B of FIG. 9A.

An acoustic transducer of a third exemplary embodiment will be described with reference to FIGS. 9A and 9B. As shown in FIGS. 9A and 9B, an acoustic transducer 1*c* of the third exemplary embodiment is configured such that a plurality of strip-shaped bending vibration plates 27 are arranged radially at predetermined angle intervals around the shaft 22. The bending vibration plate 27 is connected to a shaft 22 and a connection member 26. A strip-shaped piezoelectric vibrator 28 is bonded to one surface or both surfaces of each of the bending vibration plates 27. The bending vibration plate 27 and the piezoelectric vibrator 28 constitute a strip-shaped bending vibration module 29.

The bending vibration module 9 which is constituted by the disc-shaped bending vibration plate 7 and the ring-shaped piezoelectric vibrator 8 of the first exemplary embodiment shown in FIG. 1A has large rigidity in the circumferential direction, such that the displacement of the bending vibration plates 7 may be disturbed.

According to the acoustic transducer 1*c* of the third exemplary embodiment, the strip-shaped bending vibration module 29 is provided, such that the rigidity in the radial direction can be reduced compared to the bending vibration module 9 of the first exemplary embodiment, the displacement of the bending vibration plates 27 can be increased, and the excluded medium volume by the acoustic radiation plates 24 and 25 can be increased.

The volume occupied by the bending vibration plates 27 and piezoelectric vibrators 28 in the bending vibration plates 27 can be reduced compared to the disc-shaped bending radiation plates, thus the reduction in weight of the acoustic transducer 1*c* can be achieved.

Figure 10A:
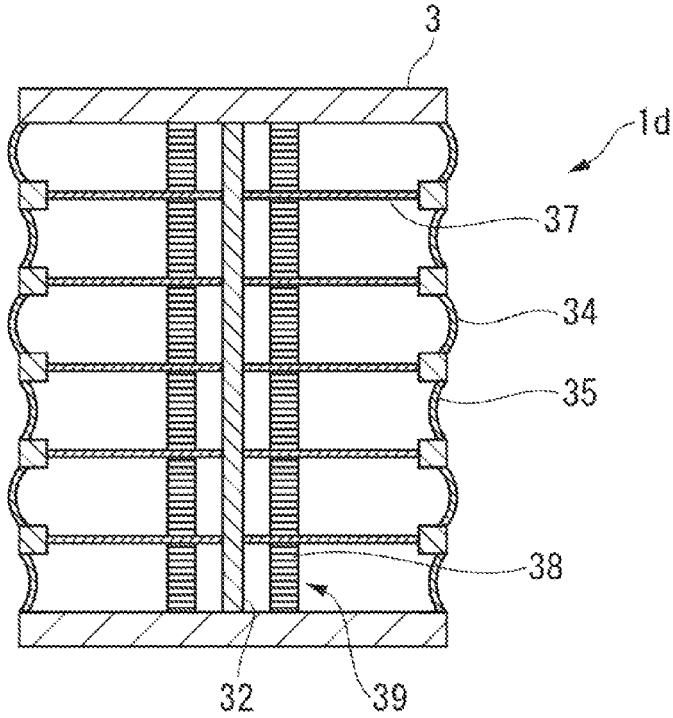
FIG. 10A is a diagram showing an example of an acoustic transducer according to a fourth exemplary embodiment of the invention.
Figure 10B:
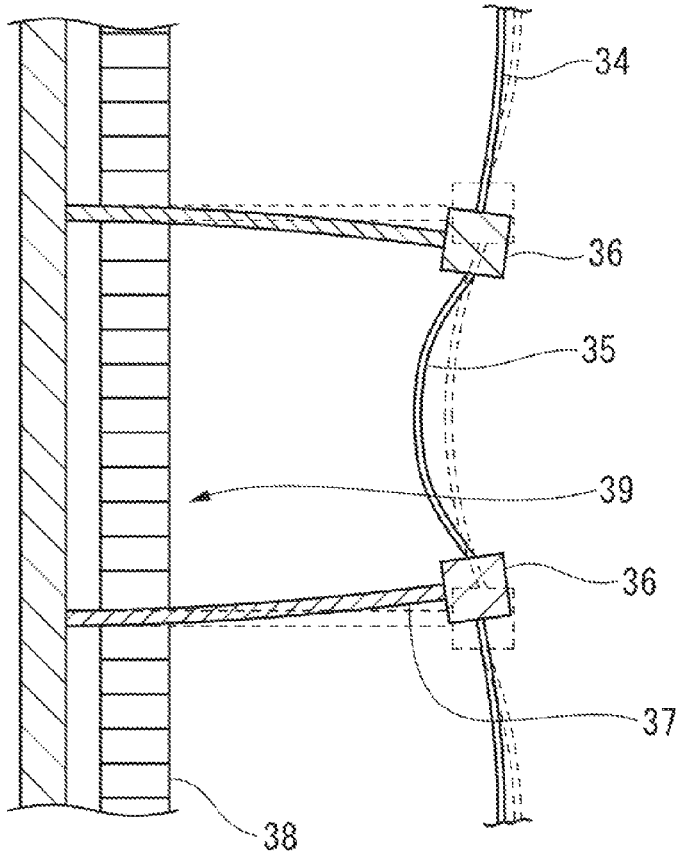
FIG. 10B is a diagram illustrating an operation of the acoustic transducer shown in FIG. 10A.

An acoustic transducer of a fourth exemplary embodiment will be described with reference to FIGS. 10A and 10B. As shown in FIGS. 10A and 10B, in an acoustic transducer 1*d* of the fourth exemplary embodiment, drive modules 39 having a plurality of ring-shaped or rectangular piezoelectric vibrators 38 laminated on each other, are each arranged between adjacent bending vibration plates 37. The drive modules 39 connect adjacent bending vibration plates 37, and are provided near a shaft 32 of the bending vibration plates 37.

The drive module 39 has a structure in which the piezoelectric vibrators 38 expand or contract upon application of a voltage. It is set that the expansion and contraction directions of adjacent drive modules 39 are opposite to each other, and the displacement directions of adjacent bending vibration plates 37 are opposite to each other.

In order to making the expansion and contraction directions of adjacent drive modules 39 be opposite to each other, for example, the drive modules 39 are structured such that piezoelectric vibrators 38 having a upward polarization direction and piezoelectric vibrators 38 having a downward polarization direction are alternately laminated on each other. Alternatively, the drive modules 39 are structured such that piezoelectric vibrators 38 are laminated on each other with their polarization directions of an upward or downward direction being unified in a laminated direction and the connection lines of the piezoelectric vibrators 38 being inverted. In this way, the piezoelectric vibrators 38 are laminated while adjusting the polarization direction or connection directions such that the expansion and contraction directions of adjacent drive modules 39 differ.

When the length of the drive modules 39 is reduced, as shown in FIG. 10B, the bending vibration plates 37 are displaced to approach each other, and the two connection members 36 are close to each other, such that the second acoustic radiation plate 35 between the connection members 36 is displaced inwardly with an increasing flexural curvature and inward medium exclusion is performed. Meanwhile, the first acoustic radiation plates 34 adjacent to this second acoustic radiation plate 35 are extended inwardly and displaced with a decreasing curvature, such that inward medium exclusion is performed.

When the length of the drive modules 39 is expanded, the bending vibration plates 37 are displaced to be away from each other, and the two connection members 36 are separated from each other, and the second acoustic radiation plate 35 between the connection members 36 is extended outwardly and displaced with a decreasing curvature, such that outward medium exclusion is performed. Meanwhile, the first acoustic radiation plates 34 adjacent to this second acoustic radiation plate 35 are bent outwardly and displaced with an increasing curvature, such that outward medium exclusion is performed.

According to the acoustic transducer 1*d* of the fourth exemplary embodiment, the drive modules 39 arranged near the shaft 32 of the bending vibration plates 37 connect adjacent bending vibration plates 37, thus bending vibration plates 37 are displaced greatly at the outer edges thereof where the connection members 36 is provided rather than the vicinity of the shaft 32 positioned at the center. Therefore, the displacement of the drive modules 39 can be expanded and transferred to the first and second acoustic radiation plates 34 and 35.

Figure 11A:
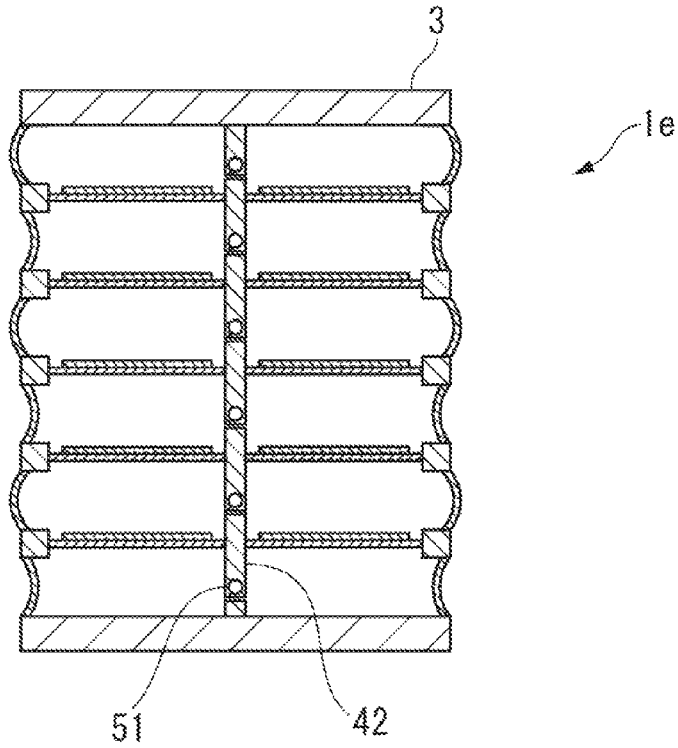
FIG. 11A is a diagram showing an example of an acoustic transducer according to a fifth exemplary embodiment of the invention.
Figure 11B:
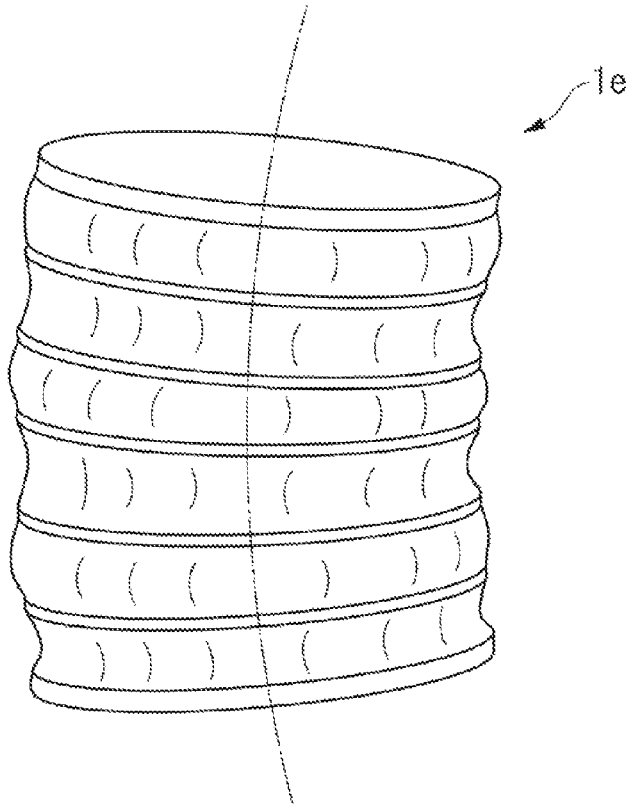
FIG. 11B is a perspective view of the acoustic transducer shown in FIG. 11A.

An acoustic transducer of a fifth exemplary embodiment will be described with reference to FIGS. 11A and 11B. As shown in FIG. 11A, in an acoustic transducer 1*e* of the fifth exemplary embodiment, hinges 51 are provided in a shaft 42.

Since the hinges 51 are provided in the shaft 42, the shaft 42 can be modified to a structure having a curvature, not a straight line, in the axial direction. Thus, the acoustic transducer 1*e* can be configured so as to be modified to a structure having a curvature shown in FIG. 11B, not a straight line, in the axial direction.

Like a towing body, when the acoustic transducer is accommodated in a tube, there are many cases where bending stress is applied to acoustic transducer, and since the acoustic transducer of the related art is not flexible, the acoustic transducer is damaged due to the bending force.

Thus, in the acoustic transducer 1*e* of the fifth exemplary embodiment, the hinges 51 are provided in the shaft 42, such that the acoustic transducer 1*e* can be modified to a structure having a curvature, not a straight line, in the axial direction. Therefore, bending stress is absorbed when the acoustic transducer is accommodated, such that the acoustic transducer 1*e* can be prevented from being damaged.

Figure 12:
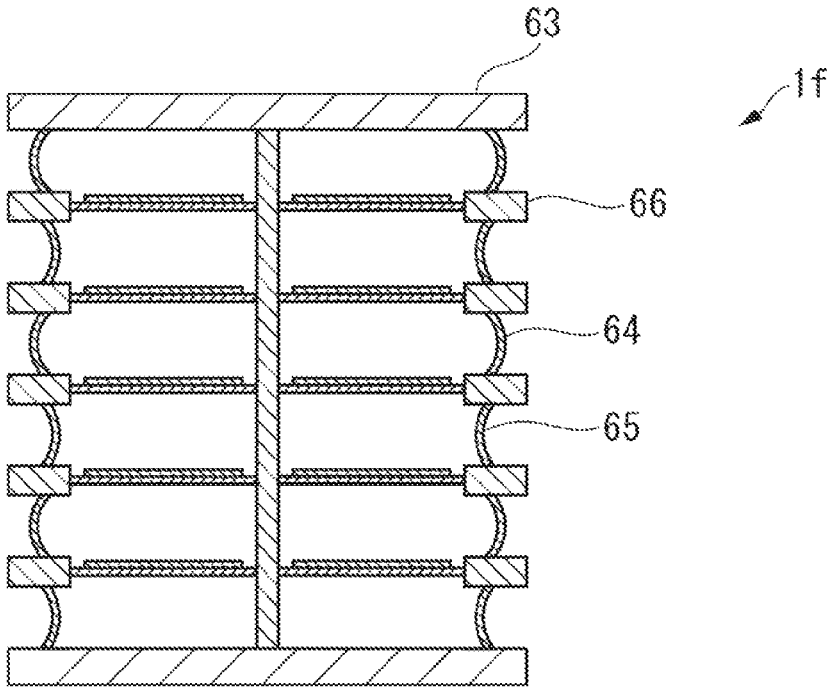
FIG. 12 is a diagram showing an example of an acoustic transducer according to a sixth exemplary embodiment of the invention.

An acoustic transducer of a sixth exemplary embodiment will be described with reference to FIG. 12. As shown in FIG. 12, an acoustic transducer 1*f* of the sixth exemplary embodiment is configured such that the outer edges of end plates 63 and connection members 66 are greater than the outer edges of first and second acoustic radiation plates 64 and 65. That is, the outer edges of the end plate 63 and the connection members 66 are located outside the outer edges of the first and second acoustic radiation plates 64 and 65 in the radial direction of the first and second acoustic radiation plates 64 and 65.

Like a towing body, in the case where the acoustic transducer is accommodated in a tube, it is not preferable that the acoustic radiation plate is in contact with the tube because it causes change in the acoustic radiation characteristic.

Thus, according to the acoustic transducer 1*f* of the sixth exemplary embodiment, since the outer edges of the end plates 63 and the connection members 66 are greater than the outer edges of the first and second acoustic radiation plates 64 and 65, the first and second acoustic radiation plates 64 and 65 can be prevented from coming into contact with the tube or the like.

Figure 13:
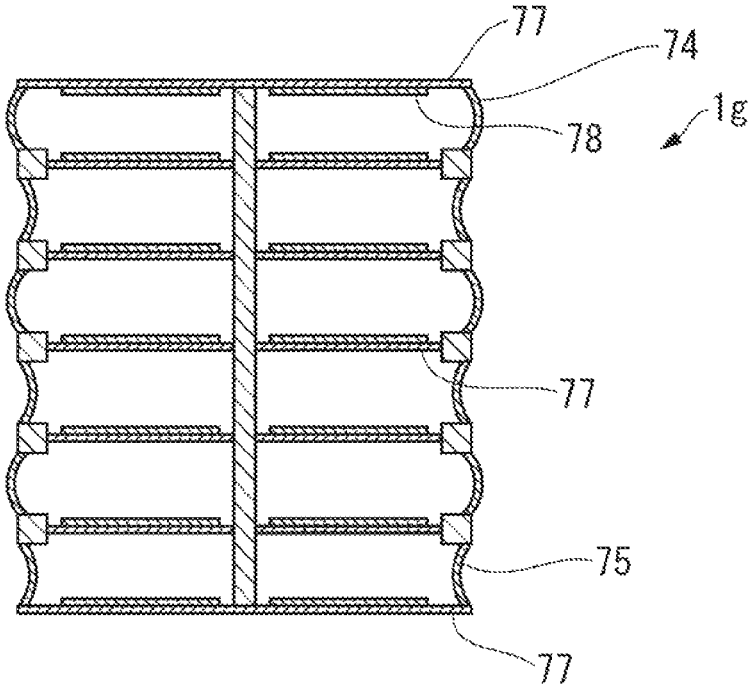
FIG. 13 is a diagram showing an example of an acoustic transducer according to a seventh exemplary embodiment of the invention.
Figure 14A:
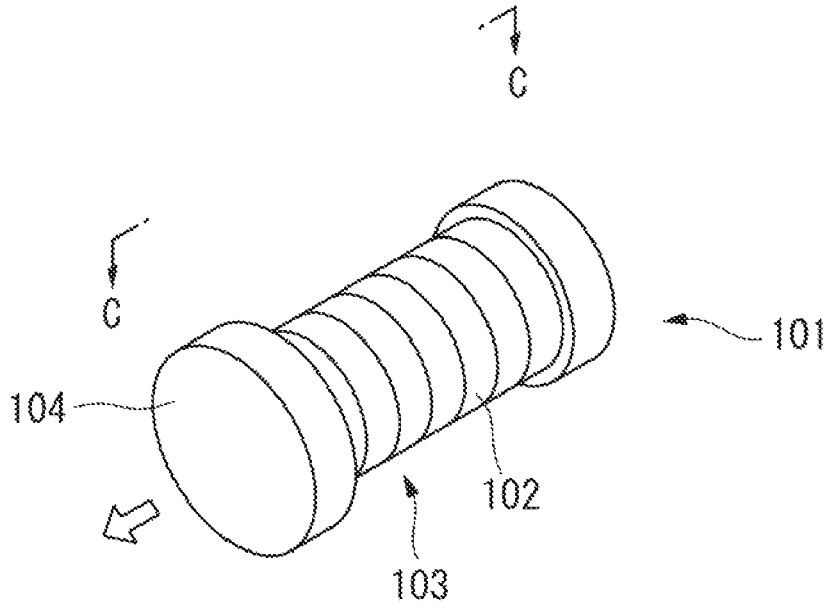
FIG. 14A is a diagram showing a bolted Langevin type acoustic transducer of the related art.
Figure 14B:
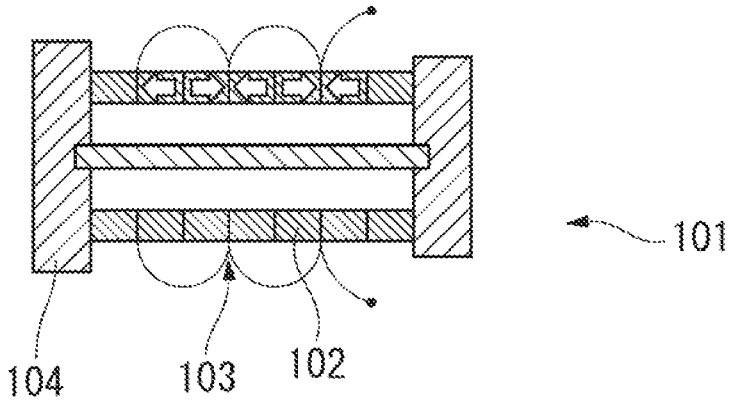
FIG. 14B is a sectional view taken along line C-C of FIG. 14A.
Figure 15A:
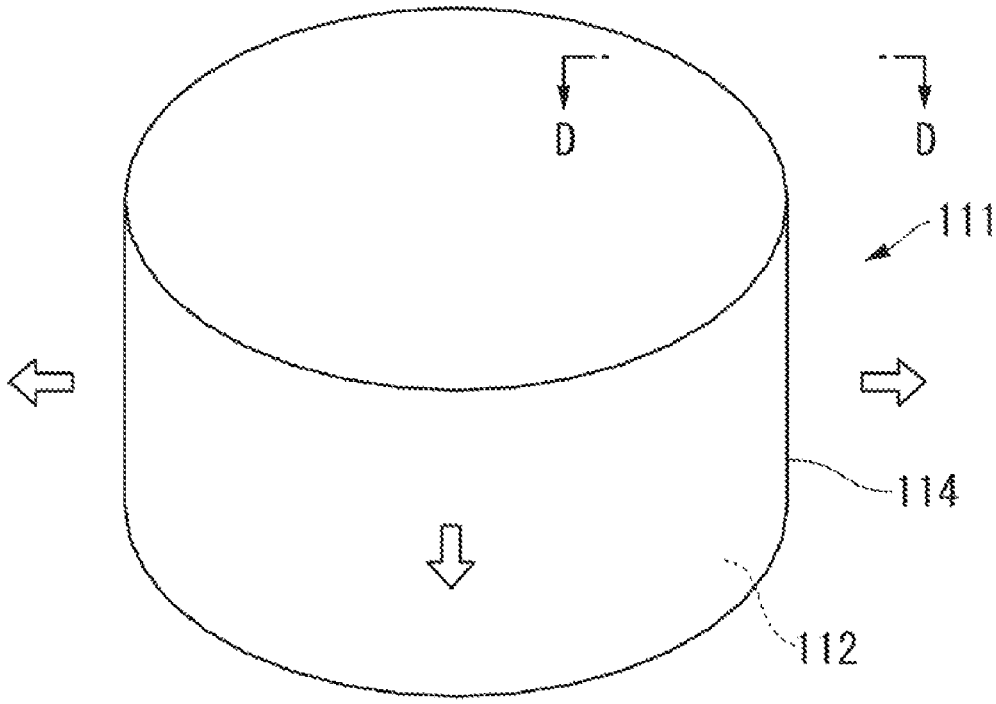
FIG. 15A is a diagram showing a cylindrical acoustic transducer of the related art.
Figure 15B:
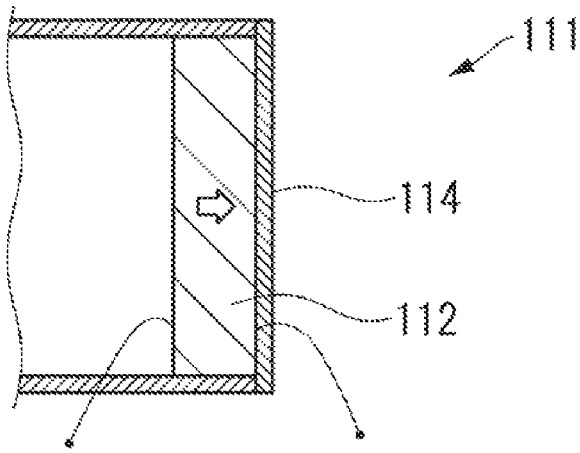
FIG. 15B is a sectional view taken along line D-D of FIG. 15A.
Figure 16A:
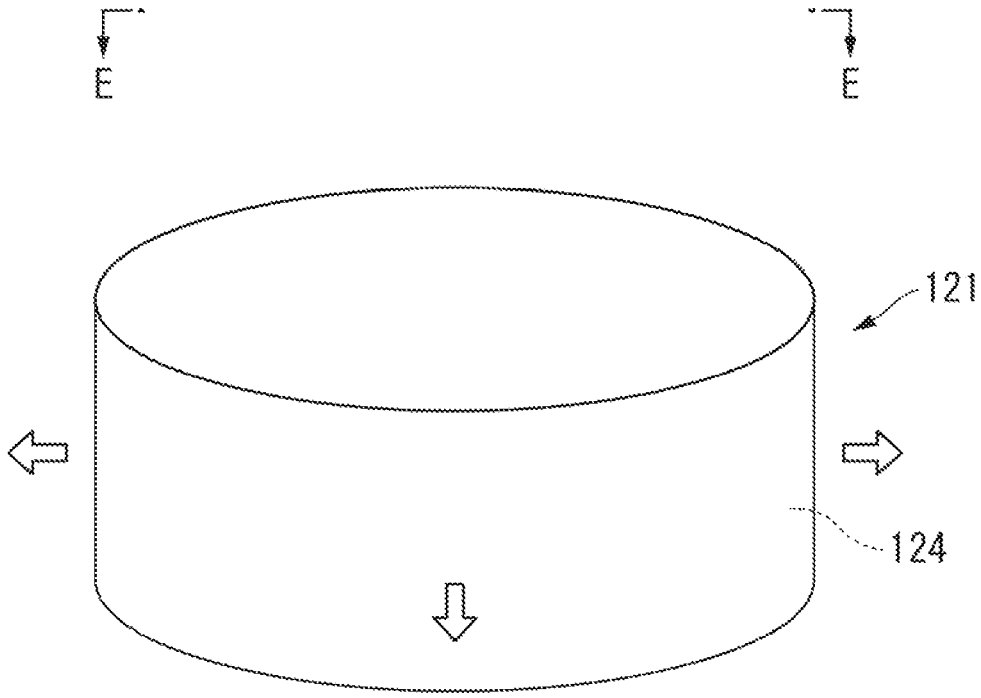
FIG. 16A is a diagram showing a flextensional acoustic transducer of the related art.
Figure 16B:
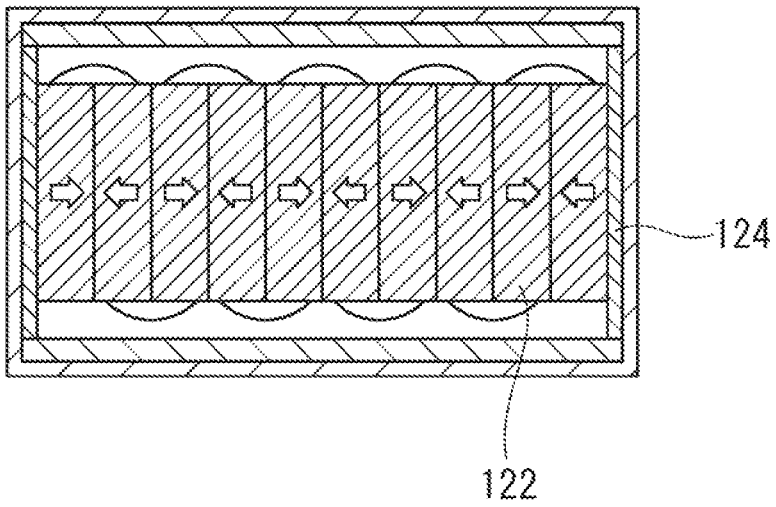
FIG. 16B is a sectional view taken along line E-E of FIG. 16A.
Figure 17A:
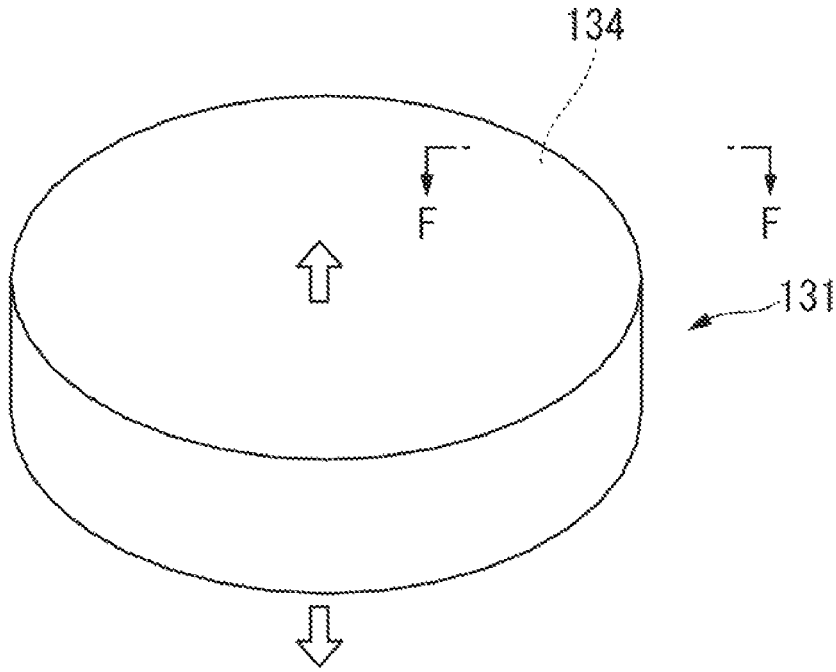
FIG. 17A is a diagram showing a bending disc-type acoustic transducer of the related art.
Figure 17B:
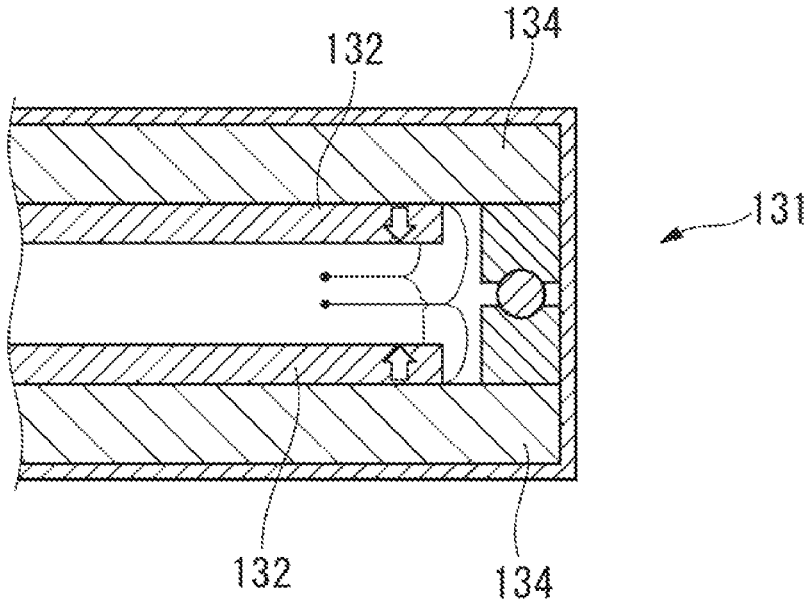
FIG. 17B is a sectional view taken along the line F-F of FIG. 178.
Figure 18A:
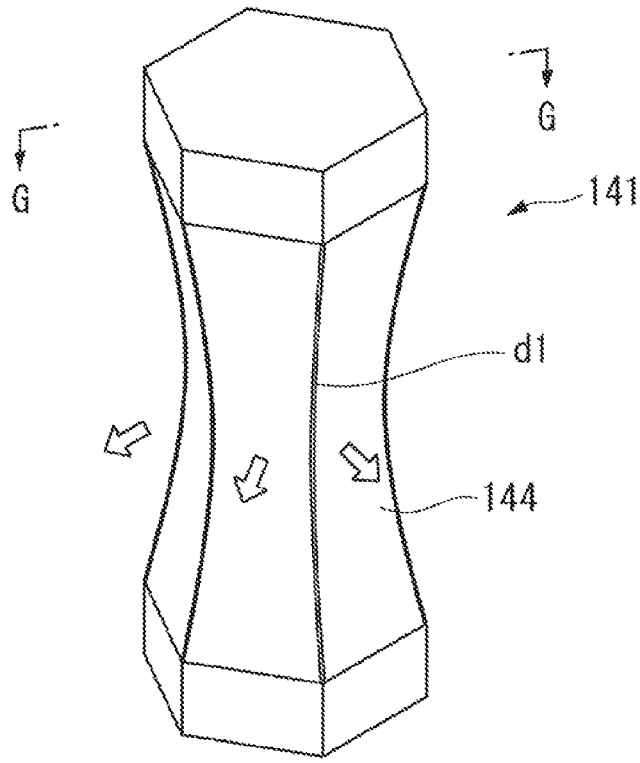
FIG. 18A is a diagram showing a barrel stave-type acoustic transducer of the related art.
Figure 18B:
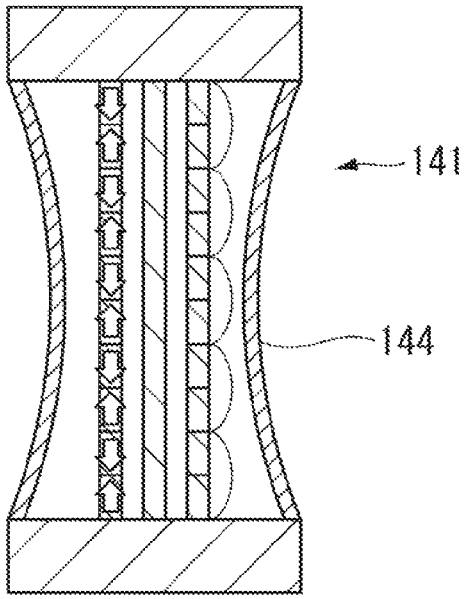
FIG. 18B is a sectional view taken along line G-G of FIG. 18A.

An acoustic transducer of a seventh exemplary embodiment will be described with reference to FIG. 13. As shown in FIG. 13, an acoustic transducer 1*g* of the seventh exemplary embodiment is configured such that, instead of end plates, bending vibration plates 77 having piezoelectric vibrators 78 provided inward thereof are provided at both ends of a shaft 72. The bending vibration plates 77 provided at both ends of the shaft 72 are respectively connected to a first acoustic radiation plate 74 or a second acoustic radiation plate 75. The bending vibration plates 77 provided at both ends of the shaft 72 may be respectively connected to the first acoustic radiation plates 74 or the second acoustic radiation plate 75 through connection members (not shown).

Bending vibration plates 77 which are provided at portions other than both ends of the shaft 72 may have a piezoelectric vibrator on both surfaces, not one surface.

According to the acoustic transducer 1*g* of the seventh exemplary embodiment, medium exclusion can be performed by bending vibration of the bending vibration plates 77 provided at both ends of the shaft 72 Accordingly, the excluded medium volume can be increased compared to the first exemplary embodiment.

The embodiments of invention can be applied to a transmitter which performs acoustic radiation in water.

While the invention has been particularly shown and described with reference to exemplary embodiments thereof, the invention is not limited to these embodiments. It will be understood by those of ordinary skill in the art that various changes in form and details may be made therein without departing from the scope of the present invention as defined by the claims.

For example, although in the foregoing exemplary embodiments, the end plates or the bending vibration plates are provided at both ends of the shaft to prevent the ambient medium M from entering the inside of the first and second acoustic radiation plates, the embodiments may be applied to a water column resonance type acoustic transducer in which the medium M flows therein, without providing end plates or bending vibration plates at both ends of the shaft.

Although in the foregoing exemplary embodiments, the first and second acoustic radiation plates or the bending vibration plates are formed of a synthetic resin or a material containing a synthetic resin, and the material has a honeycomb structure or a laminated structure, other materials, such as a metal, may be used.

What is claimed is:

1. An acoustic transducer which radiates a sound wave into a medium, the acoustic transducer comprising:

a shaft member which extends at a center portion of the acoustic transducer;

first and second cylindrical acoustic radiation plates which have a cylindrical shape, a central axis of the first and second cylindrical acoustic radiation plates agreeing with a longitudinal axis of the shaft member, the first and second cylindrical acoustic radiation plates alternately arranged in a direction of the central axis;

a plurality of connection members which have a ring shape, and connect adjacent first and second acoustic radiation plates to each other;

a plurality of bending vibration plates each of which connects the shaft member and one of the connection members to each other; and a plurality of vibrators which are provided on the bending plates, the first acoustic radiation plate having a sectional shape which is curved outwardly in a radial direction thereof, the sectional shape of the first acoustic radiation plate being along a plane including the central axis, and the second acoustic radiation plate having a sectional shape which is curved inwardly in a radial direction thereof, the sectional shape of the second acoustic radiation plate being along a plane including the central axis.

2. The acoustic transducer according to claim 1, wherein the vibrators cause displacements of the bending vibration plates so that directions of displacements of adjacent bending vibration plates are opposite to each other.

3. The acoustic transducer according to claim 1, further comprising end plates which are provided at both ends of the shaft member and connected to the outermost first or second acoustic radiation plate in the direction of the central axis, among the arranged first and second acoustic radiation plates.

4. The acoustic transducer according to claim 3, wherein outer edges of the end plates and the connection members are located outside with respect to outer edges of the first and second acoustic radiation plates.

5. The acoustic transducer according to claim 1, wherein the bending vibration plates provided with the connection members are provided at both ends of the shaft member.

6. The acoustic transducer according to claim 1, wherein each of the bending vibration plates is a disc-like member which is inscribed in the corresponding connection member.

7. The acoustic transducer according to claim 1, wherein the bending vibration plates are strip-shaped members which are arranged radially at predetermined angle intervals around the shaft member.

8. The acoustic transducer according to claim 1, wherein the vibrators are provided on both surfaces of the bending vibration plates.

9. The acoustic transducer according to claim 1, wherein the vibrators are provided on one surfaces of the bending vibration plates.

10. The acoustic transducer according to claim 1, wherein the vibrators connect adjacent bending vibration plates to each other, are provided in a vicinity of the shaft member, and expand and contract in the direction of the central axis.

11. The acoustic transducer according to claim 1, wherein a resonance frequency of the first and second acoustic radiation plates is identical to a resonance frequency of the bending vibration plates.

12. The acoustic transducer according to claim 1, wherein the first and second acoustic radiation plates are formed of a synthetic resin or a material containing a synthetic resin.

13. The acoustic transducer according to claim 1, wherein the first and second acoustic radiation plates are formed of a material having a honeycomb structure.

14. The acoustic transducer according to claim 1, wherein the bending vibration plates are formed of a synthetic resin or a material containing a synthetic resin.

15. The acoustic transducer according to claim 1, wherein the bending vibration plates are formed of a material having a honeycomb structure or a laminated structure.

16. The acoustic transducer according to claim 1, wherein the shaft member has a hinge at an intermediate portion thereof.

17. The acoustic transducer according to claim 1, wherein a surface in contact with the medium is molded with a synthetic resin.

* * * * *